US010052564B2

(12) United States Patent
Barone

(10) Patent No.: US 10,052,564 B2
(45) Date of Patent: Aug. 21, 2018

(54) GYRATING FLYING DISC

(71) Applicant: DAB Design LLC, Red Bank, NJ (US)

(72) Inventor: Neil Barone, Rumson, NJ (US)

(73) Assignee: DAB DESIGN LLC, Red Bank, NJ (US)

( * ) Notice: Subject to any disclaimer, the term of this patent is extended or adjusted under 35 U.S.C. 154(b) by 0 days.

(21) Appl. No.: 15/715,560

(22) Filed: Sep. 26, 2017

(65) Prior Publication Data

US 2018/0015383 A1 Jan. 18, 2018

Related U.S. Application Data

(63) Continuation-in-part of application No. 15/449,747, filed on Mar. 3, 2017.

(60) Provisional application No. 62/391,566, filed on May 4, 2016.

(51) Int. Cl.
*A63H 33/18* (2006.01)

(52) U.S. Cl.
CPC ..... *A63H 33/18* (2013.01)

(58) Field of Classification Search
CPC ..... A63H 33/18; A63H 27/00; B64C 39/001
See application file for complete search history.

(56) References Cited

U.S. PATENT DOCUMENTS 3,590,518 A * 7/1971 LeBaron ..... A63H 33/18 124/17
3,697,020 A * 10/1972 Thompson ..... B64C 39/001 244/12.2
3,715,833 A 2/1973 Nickerson et al.
4,214,720 A * 7/1980 DeSautel ..... B64C 39/001 244/12.2
4,288,942 A * 9/1981 Nicholl ..... A63H 33/18 446/48
4,842,563 A 6/1989 Russell
4,889,347 A 12/1989 Mineart
5,080,623 A 1/1992 Stein
5,116,275 A 5/1992 Sassak
5,123,869 A 6/1992 Schipmann
(Continued)

FOREIGN PATENT DOCUMENTS

CN 101927095 B 8/2012
DE 202005014916 U1 12/2005
(Continued)

OTHER PUBLICATIONS

Science, "How to Build a Flying Saucer?", 2001, retrieved on Mar. 6, 2017 from http://www.theorderoftime.com/science/sciences/articles/saucer.html, 8 Pages.
(Continued)

*Primary Examiner* — John E Simms, Jr.
*Assistant Examiner* — Urszula M Cegielnik
(74) *Attorney, Agent, or Firm* — Maldjian Law Group LLC

(57) ABSTRACT

A gyrating disc is disclosed having a circular and flat shape with an edge extending perpendicularly around its circumference. The gyrating disc has a weight on the interior or exterior of the edge, or between the center and the edge. When the gyrating disc is launched in a clockwise or counterclockwise manner, the disc achieves a gyrating flight, moving on its horizontal plane and stable at the vertical axis established in the center of the disc.

25 Claims, 8 Drawing Sheets

(56) References Cited

U.S. PATENT DOCUMENTS

| | | | | |
|---|---|---|---|---|
| 5,259,802 | A * | 11/1993 | Yang | A63H 33/18 446/37 |
| 5,351,967 | A * | 10/1994 | Yang | A63B 65/10 273/142 R |
| 5,358,440 | A * | 10/1994 | Zheng | A63H 33/18 446/46 |
| 5,520,565 | A * | 5/1996 | Ulysse | A63H 33/18 244/154 |
| 5,915,533 | A * | 6/1999 | Halle | A42B 1/02 2/175.5 |
| 6,089,938 | A | 7/2000 | Spector | |
| 6,450,446 | B1 * | 9/2002 | Holben | B64C 27/00 244/12.2 |
| 6,468,123 | B1 * | 10/2002 | Valencia | A63H 33/18 446/48 |
| 6,695,666 | B2 * | 2/2004 | Nikonorov | A63H 33/18 446/46 |
| 6,860,783 | B1 * | 3/2005 | Kucha | A63H 33/18 446/46 |
| 2003/0008594 | A1 * | 1/2003 | Frybarger | A63H 33/18 446/46 |
| 2006/0178237 | A1 | 8/2006 | Roust | |
| 2006/0240735 | A1 | 10/2006 | Forti et al. | |
| 2008/0026665 | A1 * | 1/2008 | Forti | A63H 33/18 446/48 |
| 2008/0125001 | A1 * | 5/2008 | Barniak | A63H 33/18 446/46 |
| 2010/0144233 | A1 * | 6/2010 | Scarborough | A63H 27/00 446/46 |
| 2012/0302125 | A1 * | 11/2012 | Choh | A63H 27/12 446/46 |
| 2012/0322336 | A1 * | 12/2012 | Richardson | A63H 33/18 446/46 |
| 2014/0045402 | A1 | 2/2014 | Miller | |
| 2015/0038046 | A1 | 2/2015 | Lindberg | |
| 2015/0182871 | A1 * | 7/2015 | Tong | A63H 33/18 446/48 |

FOREIGN PATENT DOCUMENTS

| | | |
|---|---|---|
| DE | 202013002151 U1 | 4/2013 |
| WO | 2007038449 A1 | 4/2007 |

OTHER PUBLICATIONS

Valerie, "Active Play—DIY Flying Disc Games", Mar. 28, 2016, retrieved on Mar. 6, 2017 from http://www.notey.com/@innerchildfun_unofficial/external/8685223/active-play-%E2%80%93-diy-flying-disc-games.html, 3 Pages.

Trek Collective, "The Trek Collective", Apr. 2014, retrieved on Mar. 6, 2017 from http://www.thetrekcollective.com/2014_04_01_archive.html, 3 Pages.

* cited by examiner

GYRATING FLYING DISC

CROSS-REFERENCE TO RELATED APPLICATIONS

This application is a continuation in part of U.S. application Ser. No. 15/449,747, filed Mar. 3, 2017, which in turn claims the benefit of U.S. Provisional Application Ser. No. 62/391,566, filed May 4, 2016, both entitled "GYRATING FLYING DISC," which are incorporated herein by reference in their entireties.

FIELD OF INVENTION

Embodiments of the present invention generally relate to a flying disc and more particularly to a gyrating flying disc.

BACKGROUND

Flying discs are known objects of entertainment and are pervasively popular objects of game-play and amusement. Manipulation of physical properties of the flying discs may confer desirable variances in flight patterns such as, directional bias, velocity, and distance/height.

For example, Forti, et al. (U.S. Patent Pub. No. 2006/0250735) describes a cylinder with a pointed forward edge that edge allowing for a predictable distance of flight.

Creating a gyrating flying disc has been problematic. As described by Forti et al., (U.S. Pat. No. 5,816,880), gyrating flight can be accomplished with a cylinder-like hollow body having a leading and training edge where the leading edge is heavily weighted. This design, however, is devoid of a circular disc center, and fails to achieve desirable lift and curvature of flight. Moreover, the gyration achieved is only on the vertical axis, which is not advantageous.

Other designs include a weight on the leading edge of the disc, such as described in U.S. Pat. No. 3,590,518 to Ross. The weight, however, allows for a predetermined direction of flight. Because the leading edge is weighted, the disc effectively becomes a projectile. When launched, Ross' disc does not spin, but flies in the direction of the weighted leading edge. To facilitate launch, a separate launching device is provided. This design also includes a thickened center relative to edge, thereby diminishing the airfoil and lift achieved by the flying disc.

Still, other designs fail to achieve sustainable and predictable gyrating flight. As described in DE202005014916, a cavity within the disc holds sand, which when launched, disperses via the Coriolis Effect to the edge of the disc. Because the configurations of sand placement vary from throw to throw, a different flight pattern is achieved at each launch. This design also provides a hollow center, thus changing the dynamics of an airfoil achieved by a flying disc that is substantially uniform in thickness at its center.

A flying disc that consistently and yet preternaturally gyrates on both the vertical and horizontal axis is desired. A flying disc that gyrates and achieves flight in a spinning manner, launching from a point, and increasing in height before reaching an apex and descending is heretofore undescribed. Thus, there is a need for a flying disc that addresses the deficiencies of prior designs and provides a flying disc with an airfoil and weighted interior edge, which flies in a spinning motion with a reproducible gyrating motion from a launch, optionally reaching an apex before descent.

SUMMARY

Embodiments disclosed herein relate to a gyrating disc that is substantially circular and uniform in thickness at its center. Embodiments in accordance with the present invention further provide a gyrating disc with a curved edge, the curved edge and uniform center providing an airfoil for the achievement of sustained flight, and having a weighted portion.

Embodiments disclosed herein are further directed to a gyrating disc having a weight embedded within the interior edge, the exterior edge, or between the center and the edge.

In some embodiments, the weight comprises between about 16.5 to 21% of the weight of the total disc, and contained across between about 5% and 60%, or more specifically between about 8% and 20%, of the outer or inner circumference of the disc, e.g., in various lengths of a partial arc. In some embodiments, the weight comprises between about 5% to about 60% of the weight of the total disc. In other embodiments, the weight comprises between about 10% to about 50% of the weight of the total disc. The weight may alternatively be distributed between the center and the edge of the gyrating disc. The embodiments of the present invention provide for additional configurations of the gyrating disc as disclosed.

Embodiments in accordance with the present invention are directed to a gyrating disc which achieves a gyrating flight regardless of the orientation of the weight at launch.

Embodiments in accordance with the present invention are further directed to a gyrating disc wherein a maximum frequency of gyration is achieved when the launch originates from the weighted portion of the disc edge.

Yet other embodiments in accordance with the present invention are directed to a gyrating disc wherein distribution of the weight at the edge of the disc affects the frequency of the gyration, wherein a longer distribution of weight, occupying a larger percentage of the circumference has a lower gyrating frequency than a shorter, more concentrated weight, occupying a smaller percentage of the circumference of the gyrating disc.

In other embodiments of the present invention, the gyrating disc comprises a rigid disc of uniform thickness and having a curved edge.

In some embodiments of the present invention, the gyrating disc comprising a curved edge embedded with a weight of a dimension and magnitude so as to effect a gyrating flight when the disc is launched with either a clockwise or counterclockwise spin.

These and other advantages will be apparent from the present application of the embodiments described herein.

The preceding is a simplified summary to provide an understanding of some embodiments of the gyrating disc. This summary is neither an extensive nor exhaustive overview of the present invention and its various embodiments. The summary presents selected concepts of embodiments of the present invention in a simplified form as an introduction to the more detailed description presented below. As will be appreciated, other embodiments of the present invention are possible utilizing, alone or in combination, one or more of the features set forth above or described in detail below.

BRIEF DESCRIPTION OF THE DRAWINGS

The foregoing and other aspects of the embodiments disclosed herein are best understood from the following detailed description when read in connection with the accompanying drawings. For the purpose of illustrating the embodiments disclosed herein, there is shown in the drawings embodiments presently preferred, it being understood, however, the embodiments disclosed herein are not limited to the specific instrumentalities disclosed. Included in the drawings are the following figures.

Figure 1:
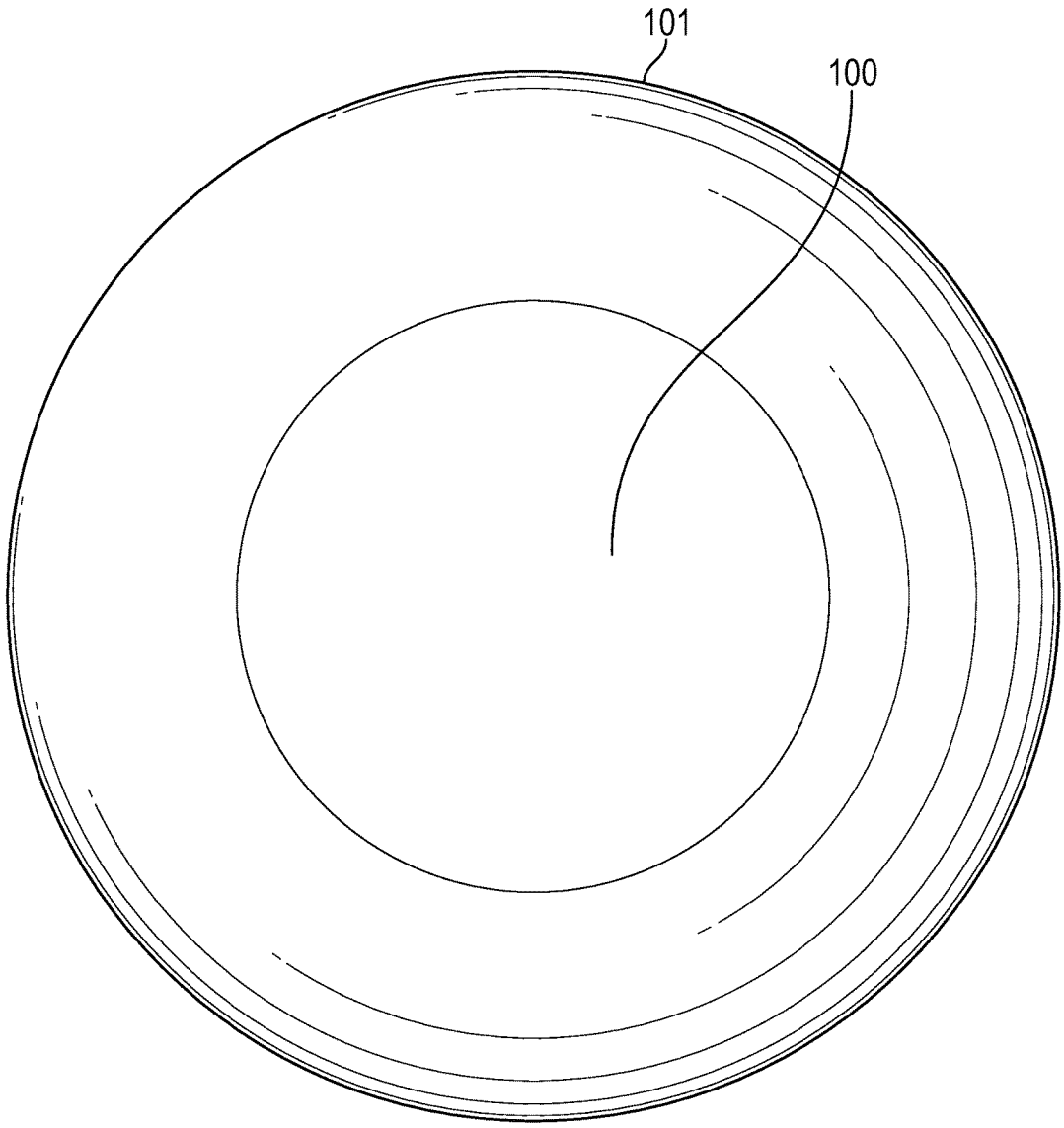
FIG. 1 illustrates a top view of a gyrating disc, according to an embodiment of the present invention.

While embodiments of the present invention are described herein by way of example using several illustrative drawings, those skilled in the art will recognize the present invention is not limited to the embodiments or drawings described. It should be understood the drawings and the detailed description thereto are not intended to limit the present invention to the particular form disclosed, but to the contrary, the present invention is to cover all modification, equivalents and alternatives falling within the spirit and scope of embodiments of the present invention as defined by the appended claims.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

Embodiments of the present invention provide a gyrating disc that achieves a gyrating flight, the flight having a launch, apex, and descent.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

FIG. 1 illustrates a top view of the gyrating disc. The disc is substantially circular in shape. When viewed in the top orientation, the uniformity of the disc is apparent. The disc comprises a center 100 and an edge 101. The gyrating disc can be comprised of a variety of materials including rubber, fabric, plastic, resin, natural and/or synthetic polymers, vinyl, fiberglass, and/or any mixtures thereof. In one preferred embodiment, the gyrating disc is comprised of polyethylene. The gyrating disc may be manufactured in multiple ways. In one embodiment, the gyrating disc is entirely manufactured through injection molding. In other embodiments the weight of the disc is manufactured separately from circular disc and edge, discussed below. While the gyrating disc in one preferred embodiment is rigid, a flexible disc is also contemplated.

Figure 2:
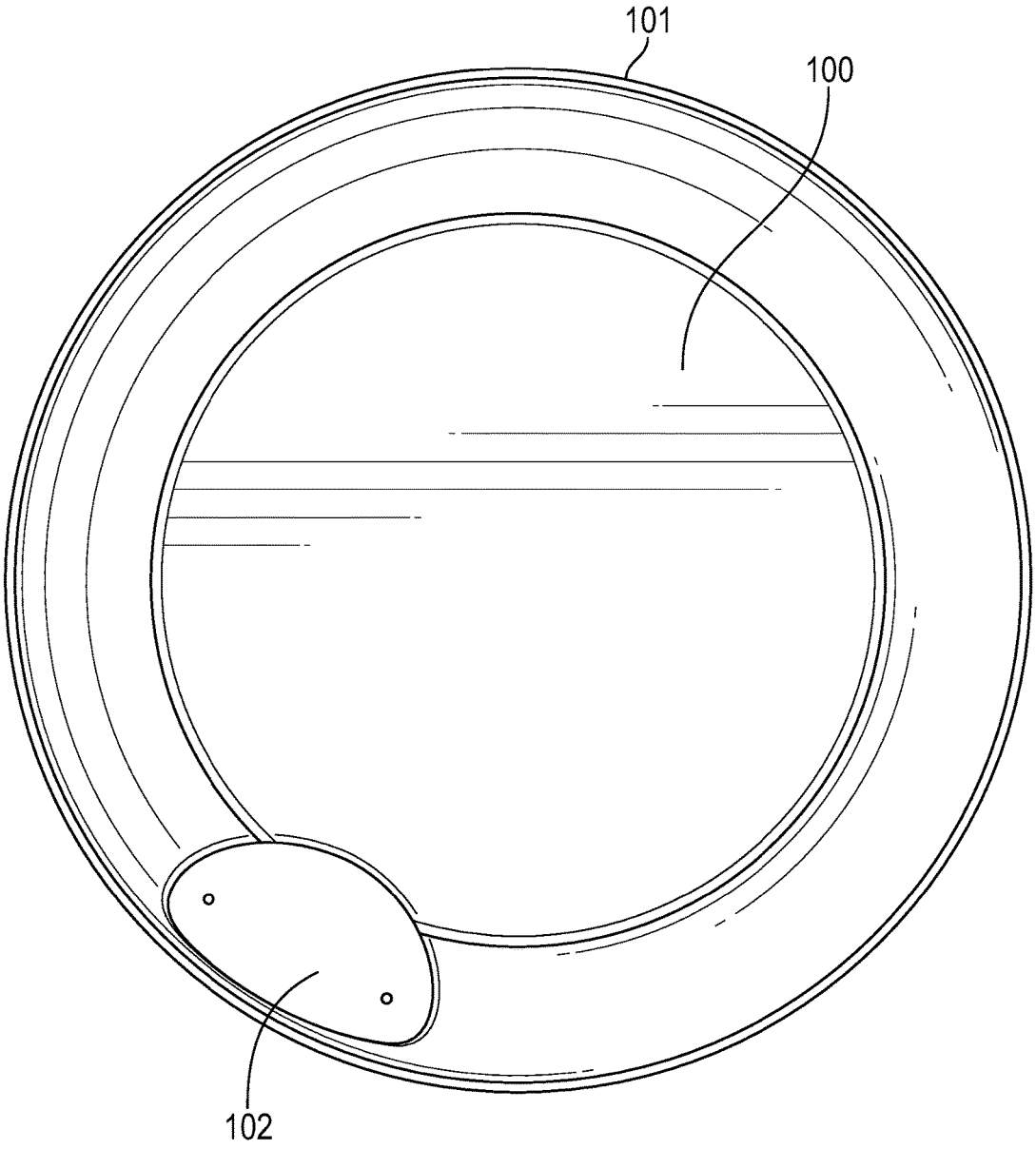
FIG. 2 illustrates a bottom view of a gyrating disc, according to an embodiment of the present invention.

FIG. 2 illustrates a bottom view of the gyrating disc. From this perspective, the weight 102 can be seen. As shown in FIG. 2, the weight 102 may be placed adjacent to the edge 101 of the gyrating disc. In some embodiments, the weight 102 is placed on the outer edge 101 of the gyrating disc. In other embodiments, the weight 102 is placed on the inner edge 101 of the gyrating disc. In yet other embodiments, the weight 102 is placed between the center 100 and edge 101 of the gyrating disc. The weight 102 can be comprised of any manner of materials, including: clay, putty, plastic, resin, natural and/or synthetic polymers, vinyl, fiberglass, and/or any mixtures thereof. In some embodiments, the weight 102 is fabricated of the same material as the gyrating disc's center 100 and edge 101. In some embodiments, the weight 102 is secured to the gyrating disc by any type of adhesive, including glues, and the like. In a preferred embodiment, the weight 102 is injection molded as one piece with the center 100 and edge 101. Without the weight 102, the disc is substantially uniform in thickness from the center 100 to the edge 101. In yet other embodiments, the gyrating disc is made from one piece (e.g., injection molding).

Figure 3A:
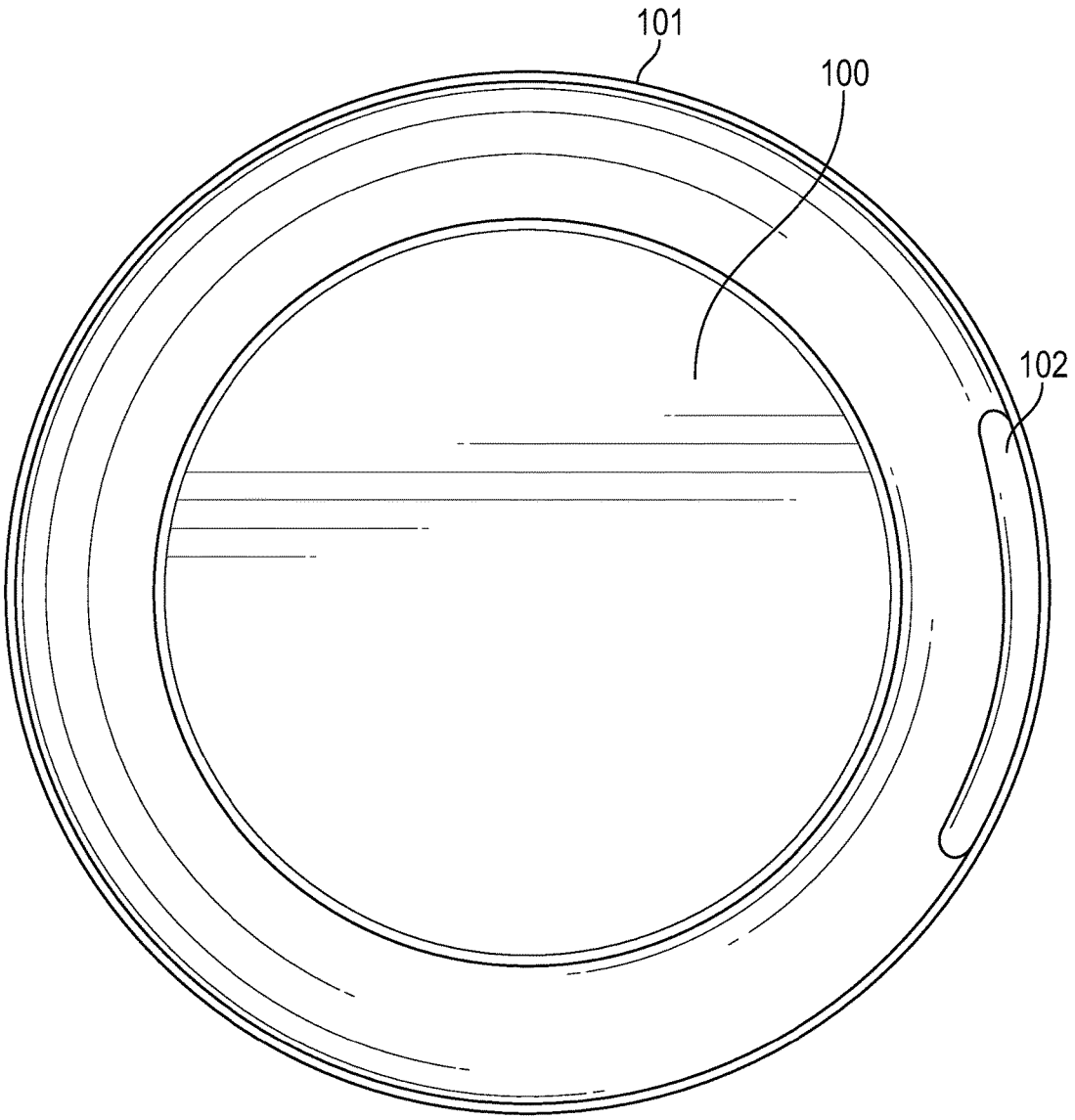
FIGS. 3A, 3B, and 3C illustrate three alternate weight configurations from a bottom view of a gyrating disc.
Figure 3B:
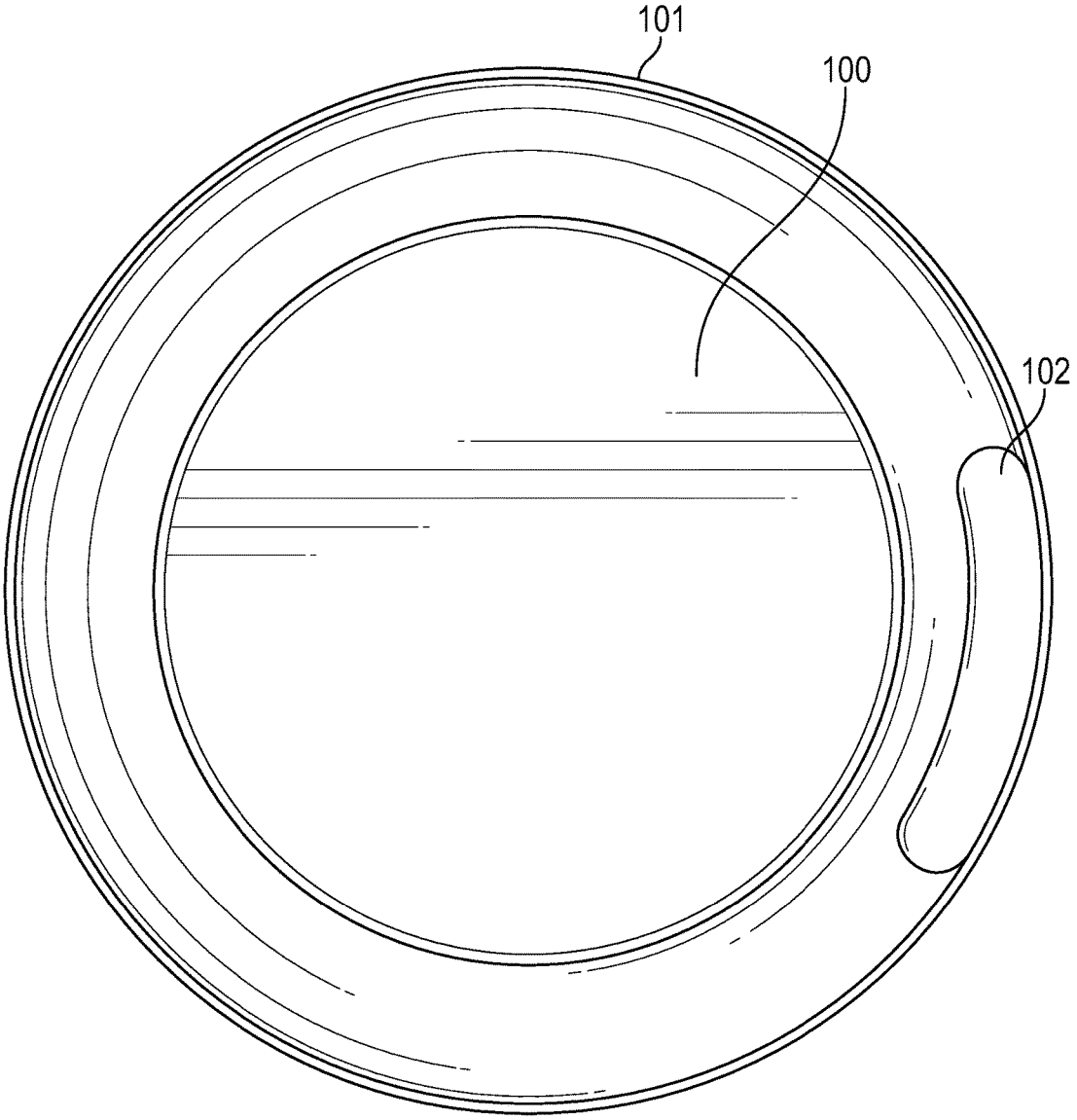
Figure 3C:
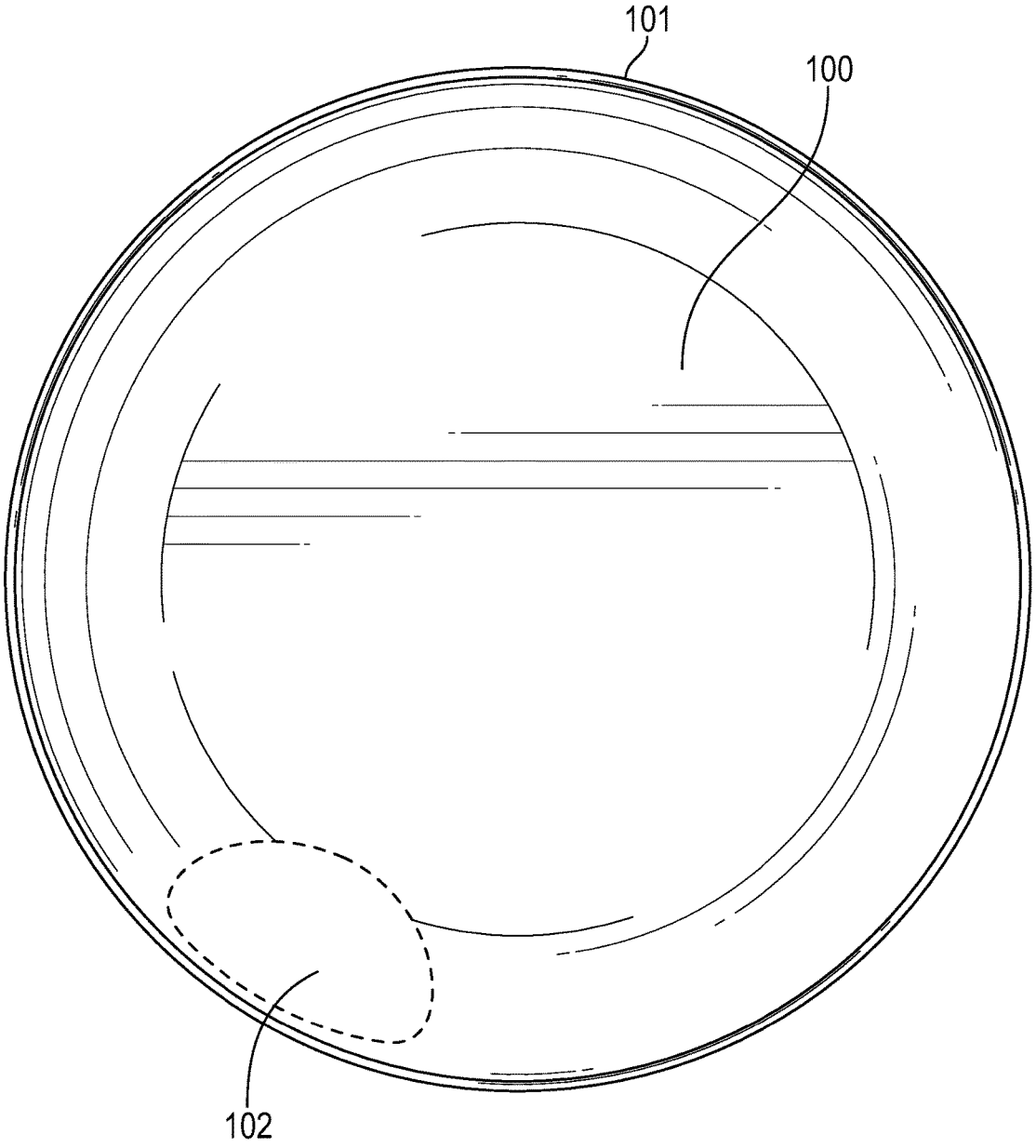
Figure 3D:
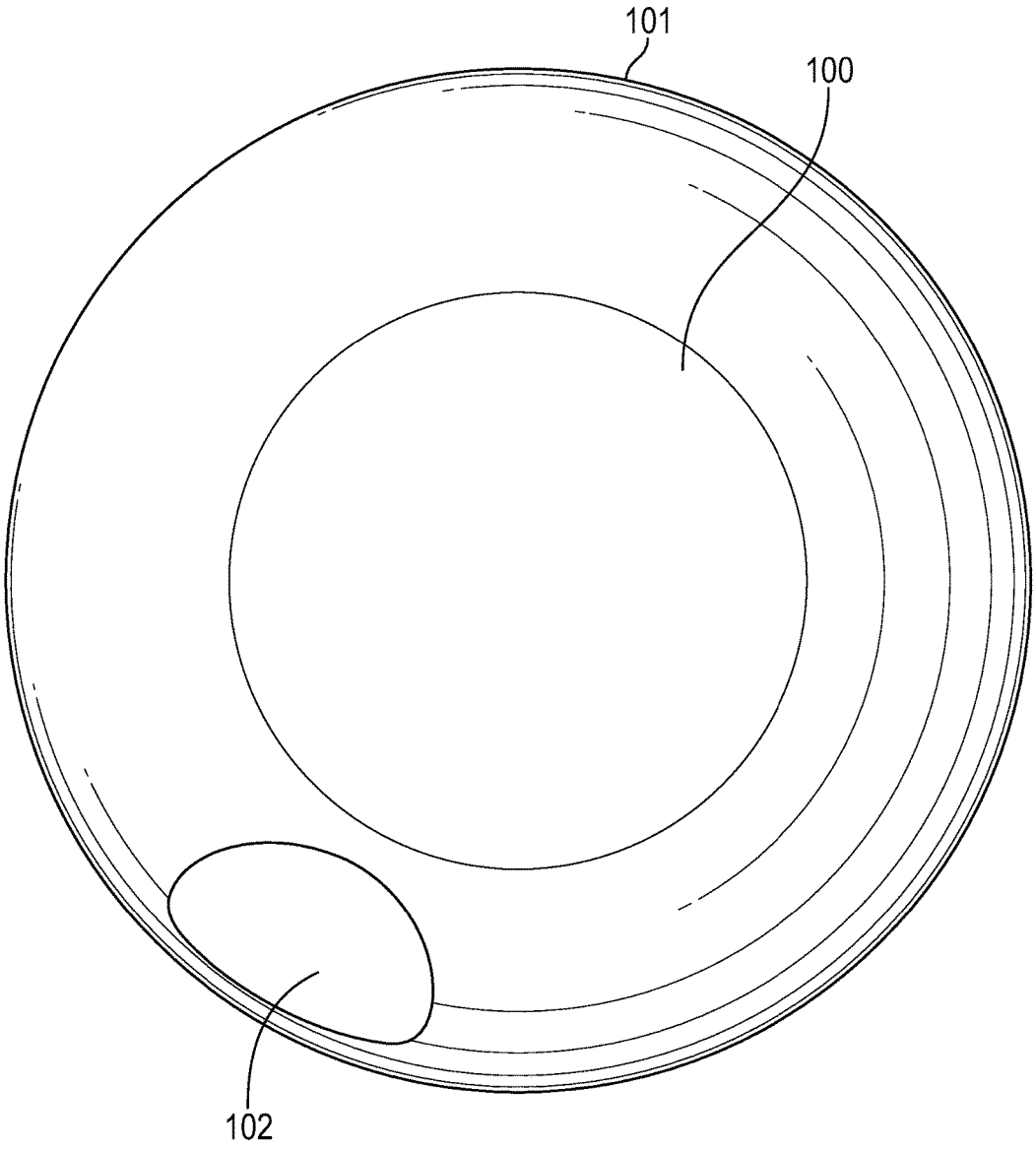
FIG. 3D illustrates the weight on the outer edge of the gyrating disc from a top view, according to an embodiment of the present invention.

FIGS. 3A, 3B, and 3C illustrate three alternate embodiments of the gyrating disc, as viewed from the bottom. In these views, it is apparent the weight 102 may vary in distribution and in size. In the embodiment illustrated by FIG. 3A, the weight 102 is longer throughout the edge 101 relative to the embodiments illustrated in FIG. 2 and FIG. 3B. In some embodiments, the gyrating disc is approximately 31 inches in circumference, and 10 inches in diameter. The gyrating disc can be made in any size (e.g., from 2-100 inches in diameter). In FIG. 3A, the weight 102 is dispersed across approximately 16% of the circumference of the gyrating disc (i.e., wherein the disc edge 101 is 31 inches in circumference, the weight is distributed 5 inches within that circumference). In FIG. 3B, the weight 102 occupies a smaller portion of the interior edge 101, about 12% (i.e., wherein the disc edge 101 is 31 inches in circumference, the weight is distributed 3.8 inches within that circumference). Other embodiments with weights occupying varying percentages of the edge are contemplated, and do not depart from the scope of the present invention. For instance, the weight could be distributed amongst 10%, 14%, 18%, or at any value between 5% and 60%, or more specifically between about 8% and 20%. The proportion of weight 102 to the circumference of the edge 101 is maintained when scaling up or down for size. While the weight 102 is shown in an elongated shape in FIGS. 3A and 3B, it is contemplated that the weight 102 may be more circular in shape, as depicted in FIG. 2. FIG. 3C illustrates the gyrating disc as manufactured in one piece. In this embodiment, it is apparent that the weight 102 is integrated within the edge 101 and center 101. FIG. 3D illustrates the gyrating disc from a top view, illustrating a weight 102 on the outer edge 101 of the gyrating disc, as in one embodiment. Moreover, other shapes such as rectangular, polygonal, or oval are contemplated and do not depart from the scope of the present invention. The weight 102 may further be shaped so as to be ergonomic for facilitating launch with a spinning motion.

In FIGS. 2, 3A, 3B, 3C, and 3D the magnitude of the weight is similar. In one preferred embodiment the weight is approximately 30 grams, and the disc is approximately 147 grams. In other embodiments, the weight is approximately 20% of the weight of the disc, or 18.8% of the total weight. In yet other embodiments the weight comprises between 16.5-21% of the total weight of the gyrating disc. In other embodiments, the disc weighs about 147 grams (5.2 ounces) and the weight is between approximately 17 grams (0.6 ounces) and approximately 145 grams (5.1 ounces), respectively, for a total weight of about 164 grams to about 292 grams. In these other embodiments, the weight by itself comprises between about 5% to about 60% of the total weight of the gyrating disc. In some embodiments, the weight itself comprises between about 10% to about 50% of the total weight of the gyrating disc. In some embodiments, the weight comprising about 25% of the total weight of the gyrating disc. Where the weight 102 is distributed over a larger portion of the edge 101, as seen in FIG. 3A, a slower frequency of gyration is achieved. Various embodiments may balance different combinations of disc weight, total weight and weight distribution in order to provide various levels of gyration, level flight (e.g., flatness of flight) and throw distance from launch to landing. The various levels may be useful in order to provide various skill levels of gyrating flying disc, e.g., a beginner level, an intermediate level, an expert level, a recreational level, a competitive sport level, a child version, an adult version, a version for windy conditions, a high-altitude version, versions specific to throwing style (forehand, backhand, etc.) and so forth. For example, a child version may be lighter compared to an adult version, a beginner level may have less gyration compared to an expert level, and a competitive sport level may provide for more level flight compared to a recreational level. Multiple versions of the gyrating flying disc, in varying skill levels or versions, may be marketed at customized price points (e.g., a competitive sport level may be priced higher than a recreational level).

Figure 4:
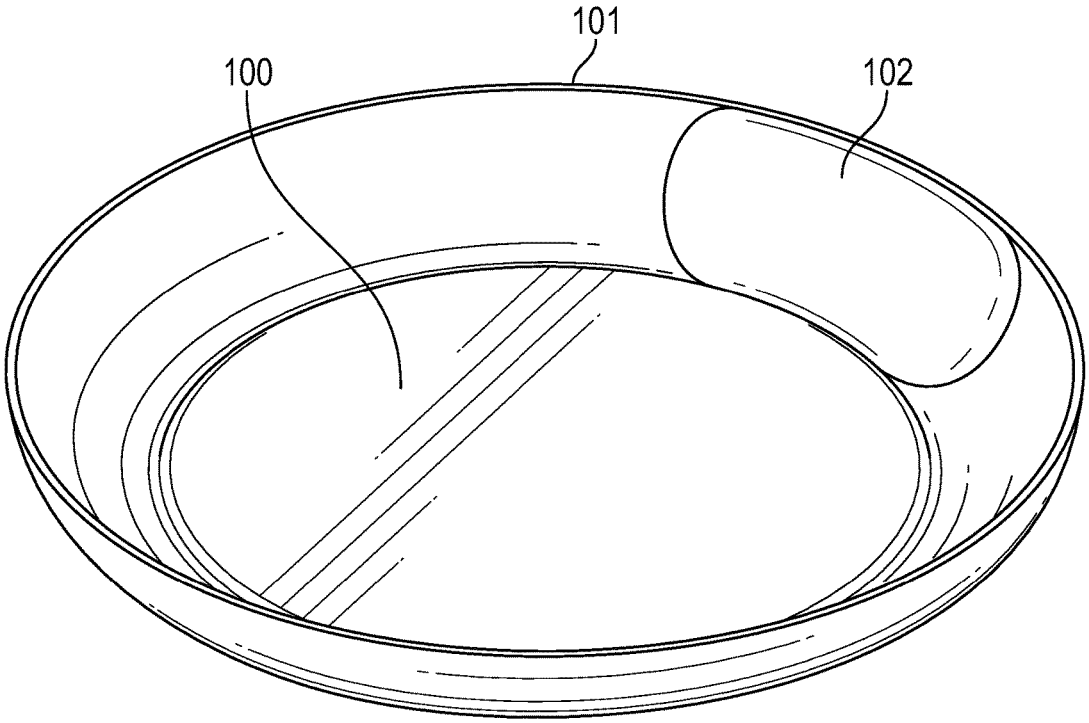
FIG. 4 illustrates an isometric view of the gyrating disc according to an embodiment of the present invention.

FIG. 4 illustrates an isometric view of the gyrating disc. From this perspective, the shape of the edge 101 can be appreciated. The edge 101 is curved in shape and substantially perpendicular to the center 100, and extends to create an overall dome-like shape of the gyrating disc. In one preferred embodiment, the edge 101 is substantially perpendicular to the center 100 of the disc, and extends approximately 1 inch relative to the center 100 of the gyrating disc. In other embodiments the edge extends between 0.5 and 1.5 inches.

Figure 5:
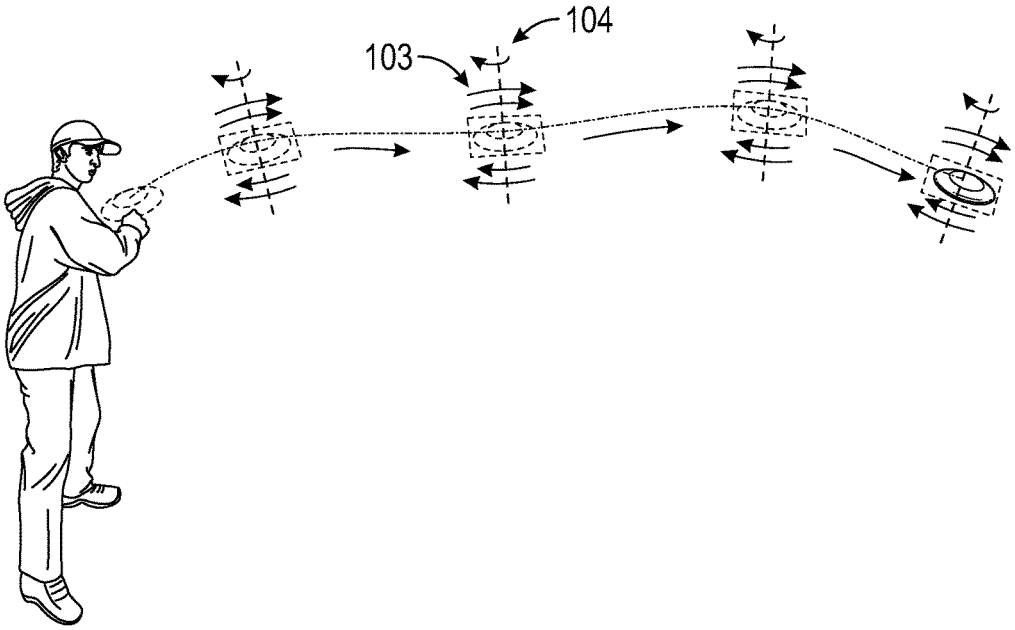
FIG. 5 illustrates a grip orientation for launch of the gyrating disc, according to an embodiment of the present invention.

FIG. 5 is an illustration of a user launching the gyrating disc, in accordance with an embodiment of the present invention. Launching the gyrating disc with a spinning motion 103 (i.e., counterclockwise or clockwise), while holding onto the weight 102 results in an optimum frequency of gyration, though gyrational flight is achieved regardless of weight orientation at launch. The gyrating disc is thrown with a spinning motion, the flight of the disc having a launch point, an apex, and a descent. While rotating in flight, the gyrating disc moves in a horizontal plane 104, with a stable vertical axis at the center of the gyrating disc. The solid center 100 and edge 101 of the gyrating disc allow for advantageous lift when launched in a spinning manner, where air moving over the top of the gyrating disc will move faster relative to the air under the disc. The momentum of the spin at launch gives the gyrating disc orientational stability by allowing the gyrating disc to receive a steady lift from the air as the gyrating disc passes through it. A launch with greater spin will increase stability of flight and increase the frequency of gyration.

Figure 6:
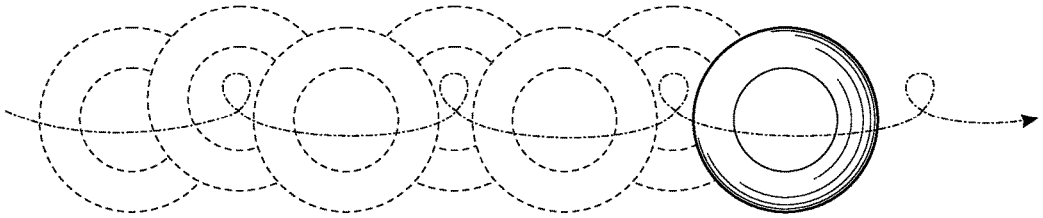
FIG. 6 illustrates a top view of a launched gyrating disc, according to an embodiment of the present invention.

FIG. 6 illustrates a top view of the gyrating disc after launch. The disc is launched with the spin in FIG. 5, 103, and oscillates on the horizontal plane 104 as it flies through the air. As stated above, the magnitude and distribution of the weight 102 as well as the momentum of the spin 103 at launch will alter the frequency of oscillation. A larger weight, with a smaller distribution, and a high spin 103 at launch will facilitate maximum gyration during flight.

The exemplary embodiments of this present invention have been described in relation to gyrating discs. However, to avoid unnecessarily obscuring the present invention, the preceding description omits a number of known structures and devices. This omission is not to be construed as a limitation of the scope of the present invention. Specific details are set forth by use of the embodiments to provide an understanding of the present invention. It should however be appreciated that the present invention may be practiced in a variety of ways beyond the specific embodiments set forth herein.

A number of variations and modifications of the present invention can be used. It would be possible to provide for some features of the present invention without providing others.

The gyrating disc of the present invention, in various embodiments, configurations, and aspects, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, configurations, and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The foregoing discussion of the present invention has been presented for purposes of illustration and description. It is not intended to limit the present invention to the form or forms disclosed herein. In the preceding Detailed Description, for example, various features of the present invention are grouped together in one or more embodiments, configurations, or aspects for the purpose of streamlining the disclosure. The features of the embodiments, configurations, or aspects may be combined in alternate embodiments, configurations, or aspects other than those discussed above. This method of disclosure is not to be interpreted as reflecting an intention the present invention requires more features than are expressly recited in each claim. Rather, as the following claims reflect, inventive aspects lie in less than all features of a single foregoing disclosed embodiment, configuration, or aspect.

Moreover, though the description of the present invention has included the description of one or more embodiments, configurations, or aspects and certain variations and modifications, other variations, combinations, and modifications are within the scope of the present invention, e.g., as may be within the skill and knowledge of those in the art, after understanding the present disclosure. It is intended to obtain rights, which include alternative embodiments, configurations, or aspects to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A gyrating disc, comprising:

a substantially circular disc having a center and an edge, the disc further comprising a weighted portion with a weight, wherein the weight is unevenly distributed around a circumference of the gyrating disc, and wherein when the disc is launched with a counterclockwise or clockwise spin, the gyrating disc will gyrate on a horizontal plane, a vertical axis being in a center of the disc, the vertical axis remaining vertical during flight.

2. The gyrating disc of claim 1, wherein the weight comprises between 5% and 60% of the total weight of the gyrating disc.

3. The gyrating disc of claim 1, wherein the weight comprises between 10% and 50% of the total weight of the gyrating disc.

4. The gyrating disc of claim 1, wherein the weight comprises about 15% and 30% of the total weight of the gyrating disc.

5. The gyrating disc of claim 1, wherein the weight, the weighted portion, and percentage of the total weight of the gyrating disc are selected to provide a predetermine combination of level of gyration, level flight, and throw distance.

6. The gyrating disc of claim 1, wherein the weighted portion is between 5% and 60% of the circumference of the disc at the edge.

7. The gyrating disc of claim 6, wherein the weighted portion is 16% of the circumference of the disc at the edge.

8. The gyrating disc of claim 1, wherein the disc is substantially uniform in thickness from the center to the edge.

9. The gyrating disc of claim 1, wherein the edge is a curved lip that is substantially perpendicular to the center of the disc, and extending between 0.5 inches and 1.5 inches.

10. The gyrating disc of claim 9, wherein the edge extends approximately 1 inch.

11. A gyrating disc, comprising:

a circular and flat center with an edge, the edge being curved and substantially perpendicular to the center; and a weight, the weight unevenly distributed on an interior circumferential portion of the edge, the weight comprising between 10% and 50% of a total weight of the gyrating disc, and wherein the weight is distributed around 5% and 60% of an inner circumference of the disc, wherein when the disc is launched with a counterclockwise or clockwise spin, the gyrating disc will gyrate on a horizontal plane, a vertical axis being in a center of the disc, and the vertical axis remaining vertical during flight.

12. The gyrating disc of claim 11, wherein the weight comprises 20% of the total weight of the gyrating disc.

13. The gyrating disc of claim 11, wherein the weight comprises about 25% of the total weight of the gyrating disc.

14. The gyrating disc of claim 11, wherein the inner portion of the edge is 16% of the circumference of the disc at the edge.

15. The gyrating disc of claim 11, wherein the disc is substantially uniform in thickness from the center to the edge.

16. The gyrating disc of claim 11, wherein the edge is a curved lip that is substantially perpendicular to the circular and flat center, and extends between 0.5 and 1.5 inches.

17. The gyrating disc of claim 15, wherein the edge extends approximately 1 inch.

18. The gyrating disc of claim 11, wherein the gyrating disc is substantially rigid.

19. A gyrating disc, comprising:

a rigid circular and flat center with a rigid edge of uniform thickness, the edge being curved and substantially perpendicular to the center and extending between 0.5 and 1.5 inches; and a weight, the weight located on an interior side of the edge and comprising between 10% and 50% of the total weight of the gyrating disc, and wherein the weight is unevenly distributed around 5% to 60% of an inner circumference of the disc, wherein when the disc is launched with a counterclockwise or clockwise spin, the gyrating disc will gyrate on a horizontal plane, a vertical axis being in a center of the disc, and the vertical axis remaining vertical during flight.

20. The gyrating disc of claim 19, wherein the weight comprises 20% of the total weight of the gyrating disc.

21. The gyrating disc of claim 19, wherein the weight comprises about 25% of the total weight of the gyrating disc.

22. The gyrating disc of claim 19, wherein the weight is distributed around 16% of the circumference of the disc at the edge.

23. The gyrating disc of claim 19, wherein the edge extends approximately 1 inch.

24. The gyrating disc of claim 19, wherein the gyrating disc is made in one piece.

25. The gyrating disc of claim 19, wherein the weight is an ergonomic shape to facilitate launch with the counterclockwise or clockwise spin.

* * * * *